United States Patent [19]

Ekstam

[11] 4,260,064

[45] Apr. 7, 1981

[54] CRANE ATTACHMENTS FOR BACKHOE AND TRACTOR

[75] Inventor: John C. Ekstam, Laurens, Iowa

[73] Assignee: Trac-Back Corporation, Laurens, Iowa

[21] Appl. No.: 859,584

[22] Filed: Dec. 12, 1977

[51] Int. Cl.[3] ..... B66C 5/00; B66C 23/00

[52] U.S. Cl. ..... 212/231; 212/189; 212/268; 414/694

[58] Field of Search ..... 212/66, 55, 58, 59 R, 212/54, 144, 145, 35, 28, 231, 189, 268; 414/680 R, 694, 718, 703; 52/118

[56] References Cited

U.S. PATENT DOCUMENTS

| | | | |
|---|---|---|---|
| 2,717,705 | 9/1955 | Jacobson | 212/66 |
| 2,917,189 | 12/1959 | Isaacs | 212/66 |
| 3,373,885 | 3/1968 | Allison | 212/55 |
| 3,643,904 | 2/1972 | McMullen | 212/66 |
| 3,836,011 | 9/1974 | Sakamoto et al. | 212/144 |
| 3,929,239 | 12/1975 | Shumaker | 212/66 |
| 3,944,081 | 3/1976 | Wellman | 212/59 R |
| 4,069,922 | 1/1978 | Hawkins | 212/59 R |

*Primary Examiner*—Stephen G. Kunin
*Assistant Examiner*—L. E. Williams
*Attorney, Agent, or Firm*—Harvey B. Jacobson

[57] ABSTRACT

An upright including upper and lower end portions is provided and support structure is carried by the lower end portion of the upright for support of the latter from one end of a vehicle. A boom including base and free end portions has its base end portion pivotally supported from the upper end portion of the upright for oscillation relative thereto about a horizontal axis extending transversely of the upright and the boom, and motor structure is operably connected between the upright and the base end portion of the boom for oscillating the boom relative to the upright. The support structure on a first disclosed form of the invention is operative to utilize the boom mounting structure of a backhoe for support of the upright from a backhoe vehicle in lieu of the backhoe boom and the support structure on a second form of the invention includes a hitch frame for removably supporting the upright from the three-point hitch of a tractor. The boom is extendible and includes a hydraulic cylinder for extension and retraction of the boom and operably connected between the base and extendible end portions of the boom in a manner designed to afford more efficient and reliable extension and retraction of the boom.

13 Claims, 14 Drawing Figures

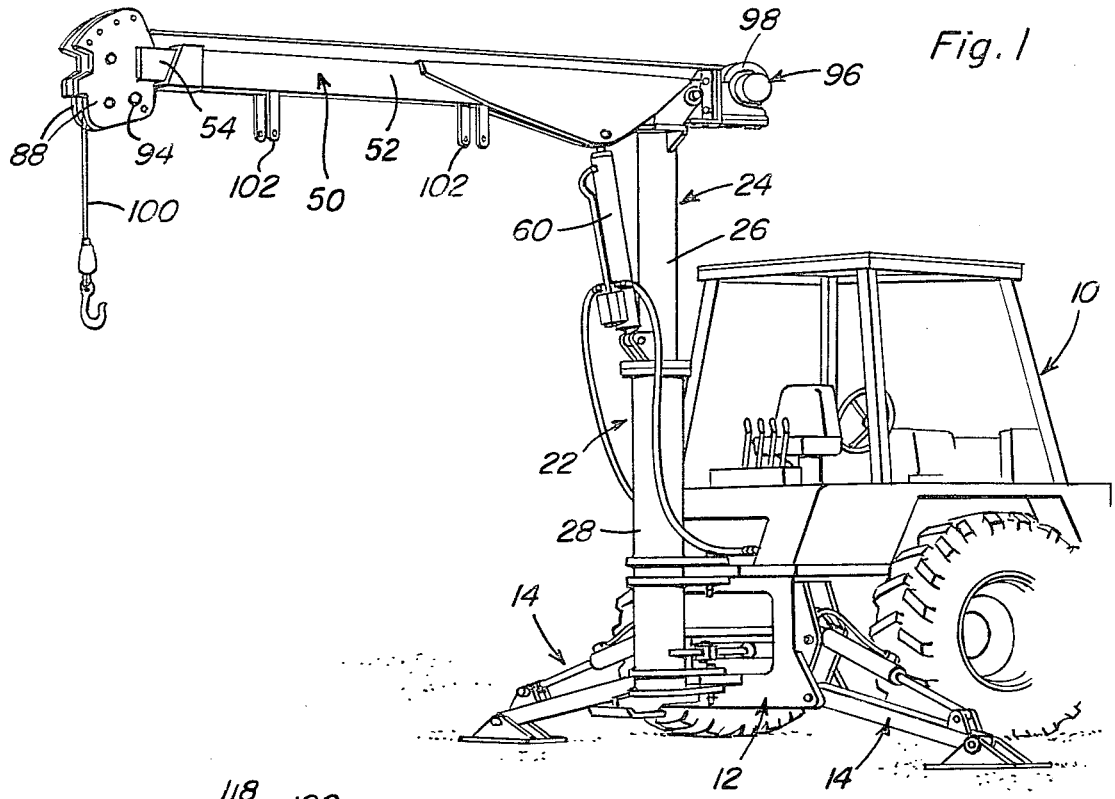
Fig. 1
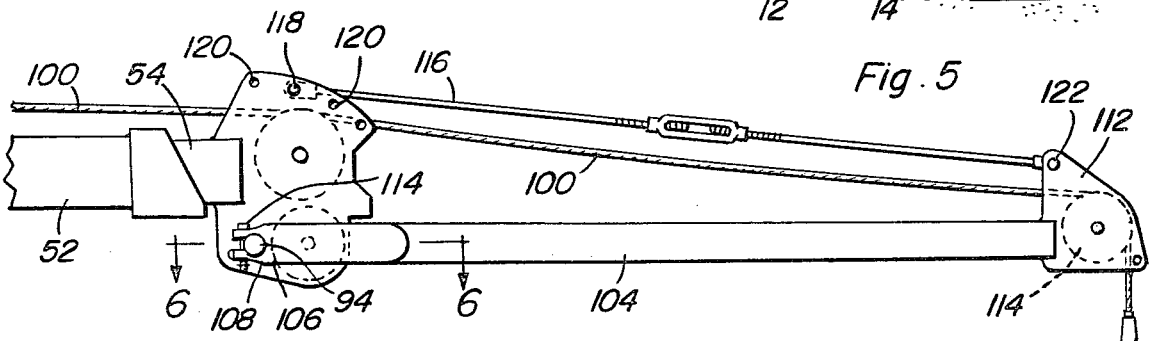
Fig. 5
Fig. 7
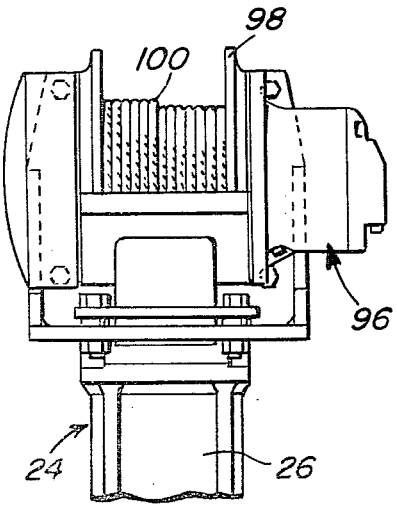
Fig. 6
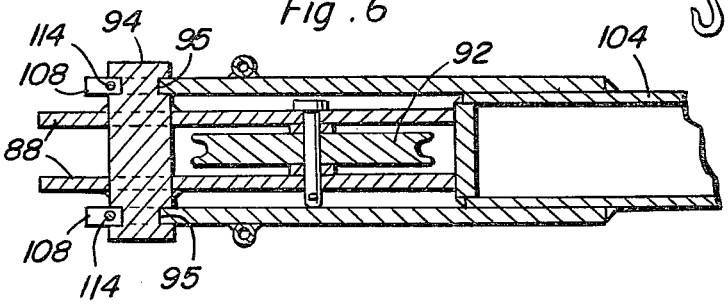
Fig. 8
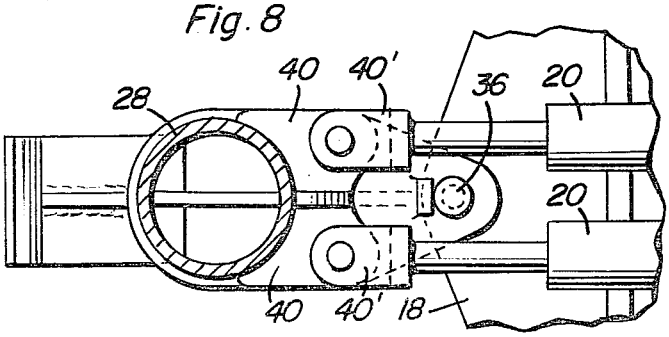

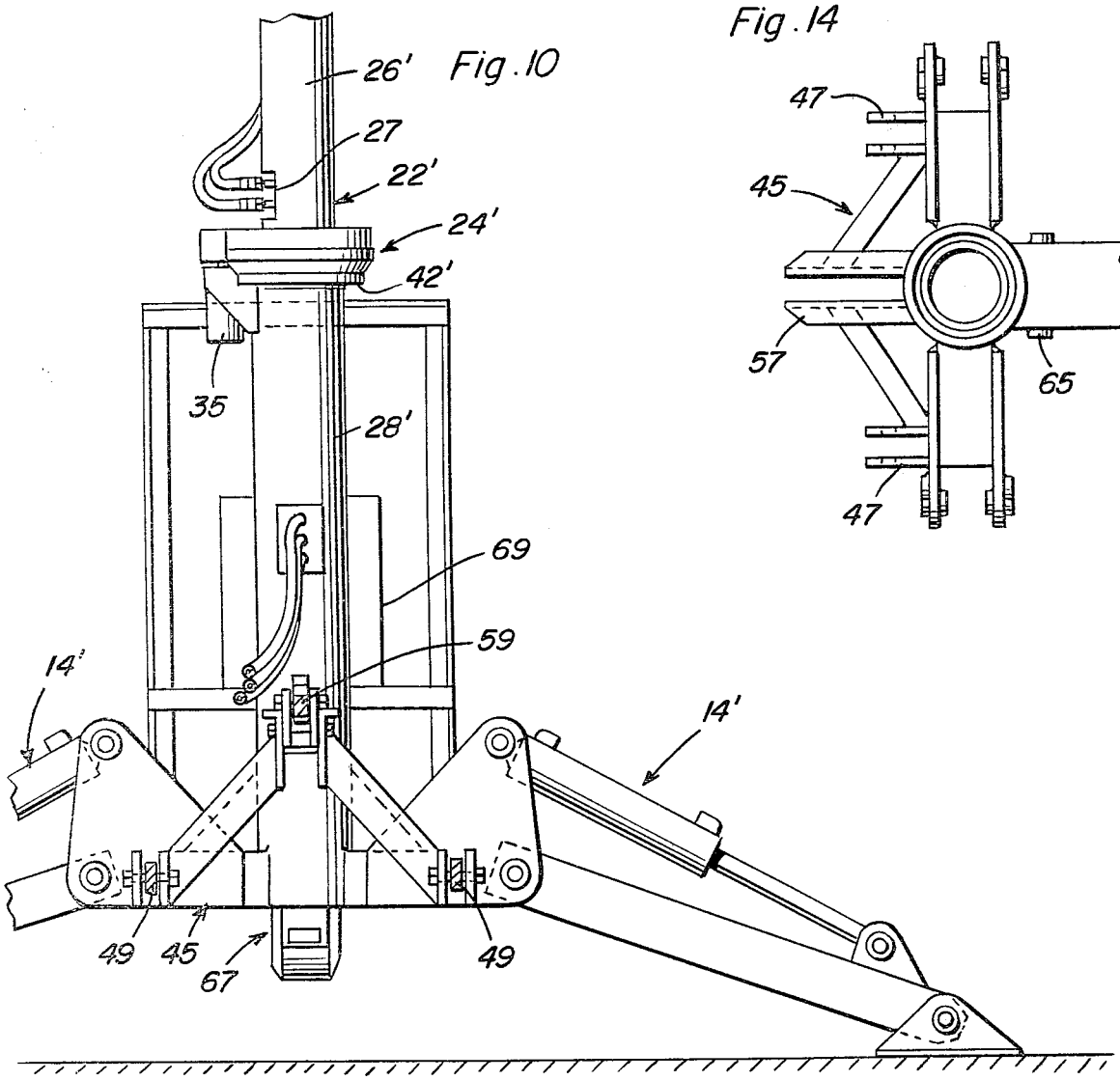
Fig. 10
Fig. 14
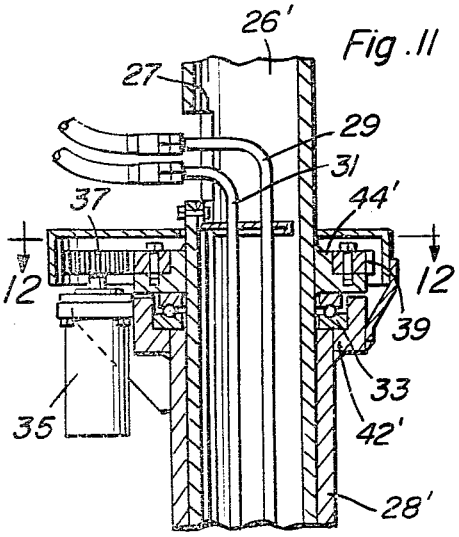
Fig. 11
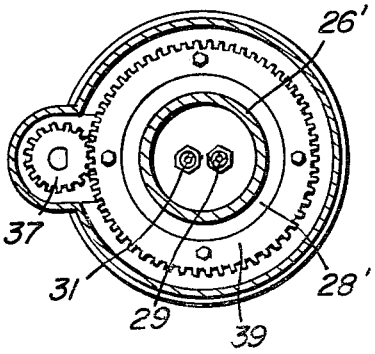
Fig. 12
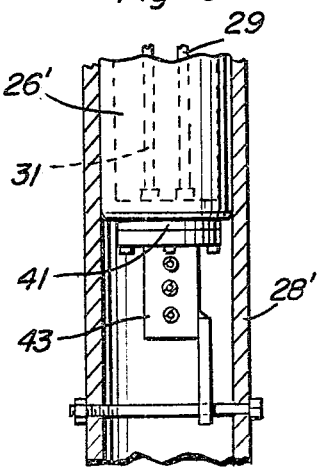
Fig. 13

CRANE ATTACHMENTS FOR BACKHOE AND TRACTOR

BACKGROUND OF THE INVENTION

Various forms of businesses having a need for a tractor equipped with a three-point hitch and for a backhoe also have a need for a crane. However, many of these businesses, while requiring frequent use of the tractor and/or backhoe, require only infrequent use of a crane. Accordingly, many businesses of this type do not incur the expense of purchasing and maintaining a crane, but rather rent a crane when the use thereof is needed.

While such business conduct may be looked upon as representing a considerable savings, more than very infrequent rental of a crane can amount to considerable expense over a period of time. Accordingly, a need exists for structure whereby a tractor equipped with a three-point hitch, or a backhoe, may be transformed, through the utilization of a crane attachment, into a mobile crane, the crane attachment representing only a small fraction of the expense of a self-propelled crane and an even less proportion of the expense of maintaining a self-propelled crane.

Various forms of self-propelled vehicles have been heretofore provided with crane attachments, but most of these are not well suited for heavy-duty crane use. Examples of various forms of crane attachment equipped self-propelled vehicles are disclosed in U.S. Pat. Nos. 1,423,724, 2,903,142, 2,914,203, 3,276,603, 3,373,885 and 3,527,362.

BRIEF DESCRIPTION OF THE INVENTION

The crane attachment of the instant invention is disclosed in two forms. A first form is adapted for support from the rear of a backhoe in lieu of the backhoe boom thereof and the second form is adapted for support from the three-point hitch of a tractor.

The crane attachment is constructed in a manner whereby it may function reliably as a heavy-duty crane and is equipped with not only an extendible boom but also a jib extension for further extending the effective reach of the boom.

In addition, the boom of the crane attachment is constructed in a manner whereby it may be efficiently extended and retracted and utilizes a novel connection between the double-acting hydraulic cylinder provided for extending and retracting the boom and the base and the extendible end portions of the boom.

The main object of this invention is to provide a crane attachment which may be mounted, in a first form thereof, on the backhoe frame of a backhoe in lieu of the primary arm of the backhoe and utilizing the swing mechanism and outriggers of the backhoe and, in a second form thereof, from the three-point hitch of a tractor.

Another important object of this invention is to provide a crane attachment including an extendible boom of novel construction.

Still another object of this invention is to provide a jib extension for the extendible end of the boom.

A further object of this invention is to provide a crane attachment which may be utilized on either a backhoe vehicle or a tractor equipped with a three-point hitch and purchased as well as maintained at a relatively low cost.

A final object of this invention to be specifically enumerated herein is to provide a crane attachment in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary, perspective view of the rear portion of a backhoe vehicle with a first form of the crane attachment of the instant invention mounted upon the rear of the backhoe vehicle from the backhoe frame of the vehicle in lieu of the primary arm of the backhoe and with the outriggers of the backhoe frame in operative position;

FIG. 5 is a fragmentary, side elevational view of the extendible end of the boom of the crane attachment with a jib extension supported therefrom;

FIG. 6 is an enlarged, fragmentary, horizontal, sectional view, taken substantially upon the plane indicated by the section line 6—6 of FIG. 5;

FIG. 7 is a fragmentary, enlarged, rear elevation view of the boom of the crane attachment;

FIG. 8 is an enlarged, fragmentary, horizontal, sectional view, taken substantially upon the plane indicated by the section line 8—8 of FIG. 2;

FIG. 10 is a fragmentary, transverse, vertical sectional view, taken substantially upon the plane indicated by the section line 10—10 of FIG. 9;

FIG. 11 is a fragmentary, enlarged, vertical sectional view, taken substantially upon the plane indicated by the section line 11—11 of FIG. 9;

FIG. 12 is a horizontal sectional view, taken substantially upon the plane indicated by the section line 12—12 of FIG. 11;

FIG. 13 is a fragmentary, vertical, sectional view illustrating a rotary coupling or manifold utilized on the crane attachment illustrated in FIGS. 9 through 12; and FIG. 14 is a fragmentary, top plan view of the hitch frame portion of the crane attachment illustrated in FIG. 9.

DETAILED DESCRIPTION OF THE INVENTION

Figures 2, 3, 4:
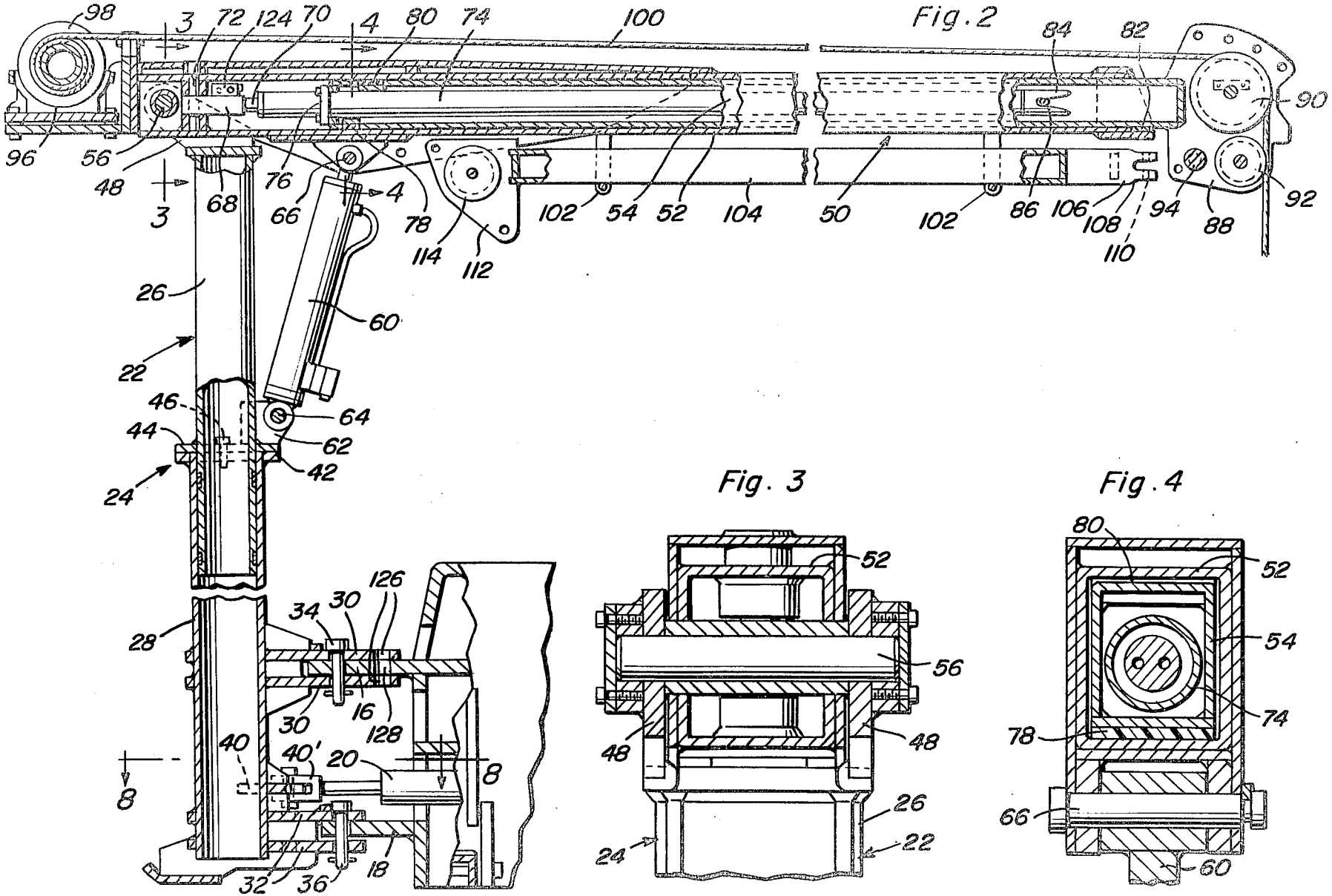
FIG. 2 is an enlarged, fragmentary, side, elevational view of the crane attachment with portions thereof being broken away and illustrated in vertical section and the points of pivotal attachment of the crane attachment relative to the backhoe frame also illustrated in vertical section.
FIG. 3 is an enlarged, fragmentary, vertical, sectional view, taken substantially upon the plane indicated by the section line 3—3 of FIG. 2.
FIG. 4 is an enlarged, fragmentary, vertical, sectional view, taken substantially upon the plane indicated by the section line 4—4 of FIG. 2.
Figure 9:
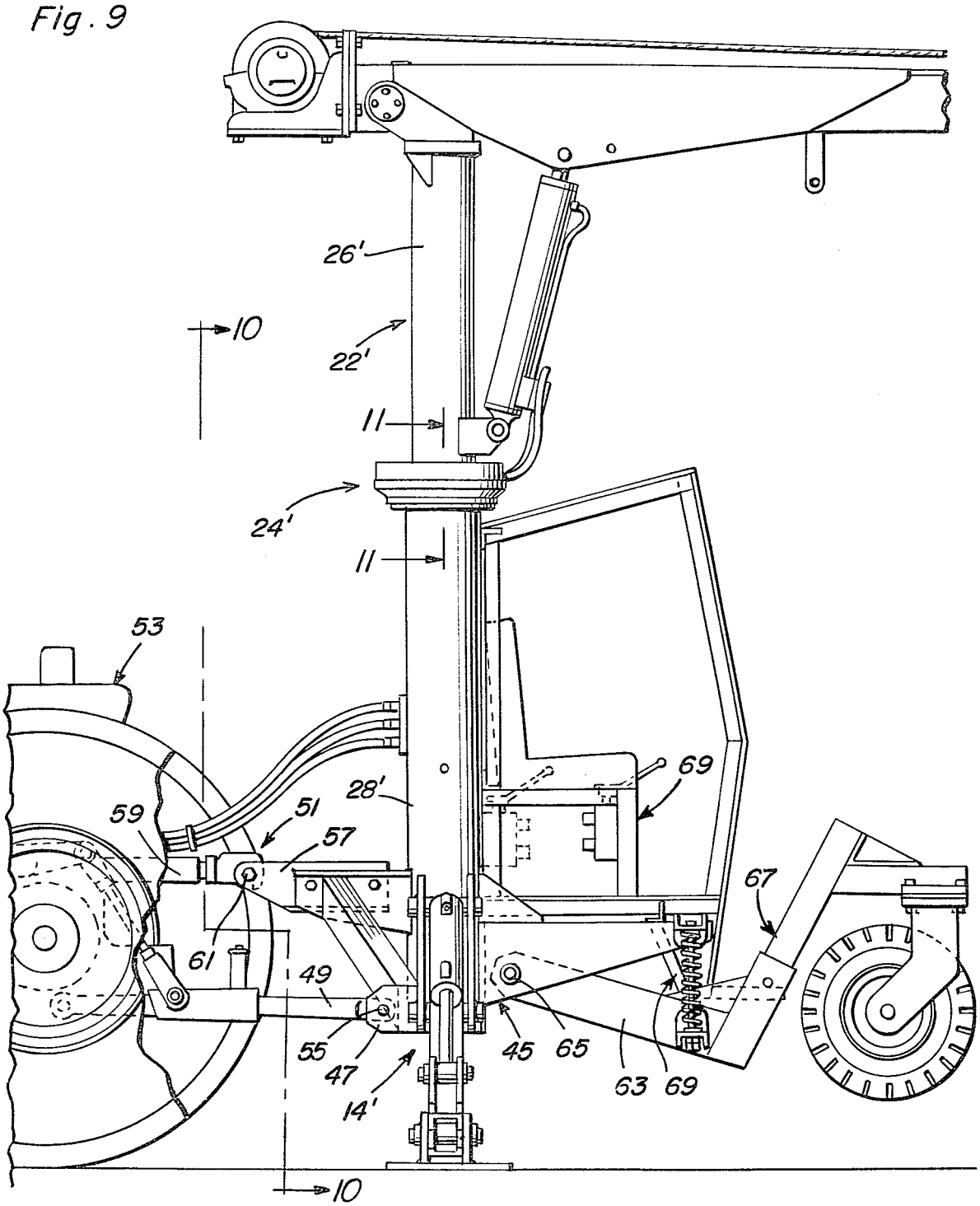
FIG. 9 is a fragmentary, side elevational view of a second form of crane attachment of the instant invention operatively associated with the three-point hitch of a tractor.

Referring now more specifically to the drawings, the numeral 10 generally designates a conventional form of backhoe vehicle including a backhoe frame referred to in general by the reference numeral 12 having conventional hydraulically actuated upwardly retractable opposite side outriggers or support leg assemblies referred to in general by the reference numeral 14. The frame 12 includes conventional vertically spaced mounting flanges 16 and 18 and opposite side swing controlling cylinders 20.

A first form of crane attachment is referred to in general by the reference numeral 22 and includes an upright referred to in general by the reference numeral 24 having upper and lower end portions 26 and 28. The lower end portion 28 includes vertically spaced pairs of vertically spaced apart mounting flanges 30 and 32 and the flanges 16 and 18 are received between the pairs of flanges 30 and 32, respectively, and aligned removable pivot pins 34 and 36 are passed through the flanges 16 and 30 and the flanges 18 and 32 whereby the upright 24 is oscillatably supported from the flanges 16 and 18. Opposite side portions of the lower end portion 28 include anchor flanges 40 to which the bifurcated rear ends 40' of the cylinders 20 are removably pivotably attached. Therefore, the cylinders 20 may be utilized to swing the upright 24 about the pins 34 and 36.

The upper end of the lower end portion 28 includes an outer annular abutment flange 42 and the upper end portion 26 includes an annular abutment flange 44 supported from the exterior thereof above the lower end of the upper end portion 26. That portion of the upper end portion 26 disposed below the flange 44 is downwardly telescoped and rotatably received within the upper end of the tubular lower end portion 28 and the flanges 44 and 42 abut against each other. In addition, a removable locking pin 46 is secured downwardly through registered portions of the flanges 44 and 42 in order to retain the upper end portion 26 in selected angularly displaced position relative to the lower end portion 28.

The upper end portion 26 includes a pair of laterally spaced apart upper end mounting plates 48 and a boom assembly referred to in general by the reference numeral 50 is supported from the upper end of the upright 24. The boom assembly 50 includes a tubular base end portion 52 and a tubular free end portion 54. A first end of the base end portion 52 is pivotally supported between the mounting plates 48 by means of a horizontal transverse pivot pin 56 and the free end portion 54 of the boom assembly 50 has a first end thereof removably telescoped into the free end of the base end portion 52.

A hydraulic cylinder 60 has one end thereof pivotally supported between mounting brackets 62 carried by the upper end portion 26 immediately above the flange 44 as at 64 and the other end of the hydraulic cylinder 60 is pivotally attached, as at 66, to the base end portion 52 on the side of the upper end portion 26 remote from the pivot pin 56.

The rectangular end 68 of a piston rod 70 is anchored relative to the base end portion 52 by means of a removable pin 72. The piston rod 70 comprises an extendible piston of a fluid motor including a cylinder portion 74 and the end of the cylinder portion 74 from which the piston rod 70 is extendible and retractable includes a mounting plate 76 which is removably secured over the terminal end of the free end portion 54 of the boom assembly telescoped into the base end portion 52. Bearing blocks 78 and 80 are carried by the free end portion 52 of the boom assembly 50 and slidingly engage the opposing inner surfaces of base end portion 52 of the boom assembly 50. Further, the base end portion 52 includes a bearing block 82 on the end thereof from which the free end portion 54 is extendible and against which the latter slides.

The end of the cylinder portion 74 remote from the piston rod 70 is bifurcated as at 84 and is removably stabilized within the end of the free end portion 54 remote from the upright 24 by means of a cross pin 86 received between the furcations of the bifurcated end 84. Further, the extendible end of the free end portion 54 of the boom assembly 50 has a pair of opposite side mounting plates 88 supported therefrom and first and second 10 inch and 8 inch diameter sheaves 90 and 92 are journaled between the plates 88 in vertically spaced relation. In addition, the plates 88 have a connecting pin or shaft 94 secured therethrough and the opposite ends of the pin or shaft 94 project endwise outwardly from the remote sides of the plates 88 and are provided with circumferential grooves 95 for a purpose to be hereinafter more fully set forth.

A motorized winch assembly referred to in general by the reference numeral 96 is supported from the base end portion 52 on the side of the pivot pin 56 remote from the upright 24 and the winch assembly 96 includes a motor driven winding drum 98 upon which a cable 100 has one end thereof wound. The cable 100 extends along the upper portion of the boom assembly 50 and is trained over the sheaves 90 and 92.

A pair of support bracket assemblies 102 are dependingly supported from longitudinally spaced portions of the base end portion 52 and removably support an extension jib 104 therefrom. The extension jib 104 includes a base end portion 106 which is bifurcated and includes a pair of opposite side furcations 108 which are each in turn bifurcated and provided with aligned bores 110 through their furcations. The opposite end of the jib 104 includes opposite side plates 112 between which a further sheave 114 is journaled. It may be seen from FIG. 2 of the drawings that the jib 104 may be stored in position beneath and generally paralleling the boom assembly 50. However, with attention invited more specifically to FIG. 5 of the drawings, it may be seen that the jib 104 may have its bifurcated furcations 108 engaged with the circumferential grooves 95 in the outwardly projecting opposite ends of the pin or shaft 94 and that retaining pins 114 may be secured through the bores 110 in order to retain the bifurcated end 106 of the jib 104 in position comprising an endwise extension for the free end portion 54 of the boom assembly 50. However, an adjustable length tension rod 116 has one end thereof anchored relative to the plates 88 by means of a fastener 118 passed through a selected pair of transverse bores 120 formed through the plates 88 and the other end of the tension rod 116 is anchored relative to the plates 112 by means of a fastener 122 secured between the plates 112 and through the corresponding end of the tension rod 116.

The backhoe 10 includes its own pressurized hydraulic system (not shown) and the cylinders 60 and 74 may receive hydraulic fluid under pressure from the backhoe hydraulic system. The rectangular end 68 of the piston rod 70 includes a hydraulic fitting 124 through which hydraulic fluid may be pumped into and exhausted from the cylinder portion 74 through the piston rod 70. Further, the flanges 30 include registered vertical bores 126 which may be registered with a vertical bore 128 formed in the flange 16 and a locking pin (not shown) may be passed through the registered bores 126 and 128 in order to retain the upright 24 against oscillation.

In operation, the free end portion 54 may be extended and retracted upon extension and retraction of the cylinder portion 74 relative to the piston rod 70. In addition, the winch assembly 86 may be actuated to wind or unwind the cable 100 relative to the winding drum 98 and the extension jib 104 may be utilized when needed with the cable 100 then trained over the sheave 114.

With attention now invited more specifically to FIGS. 9 through 14 of the drawings, there may be seen a second form of crane attachment referred to in general by the reference numeral 22'. The crane attachment 22' is generally similar to the crane attachment 22, except that the upper end portion 26' of the upright 24' thereof has a window 27, see FIG. 11, formed therein through which to receive hydraulic lines 29 and 31. In addition, a thrust and journal bearing 33 is interposed between the flanges 42' and 44' corresponding to the flanges 42 and 44 and a hydraulic motor 35 is supported from the flange 42' and includes a gear 37 on its rotatable output shaft meshed with a ring gear 39 mounted on the flange 44', whereby the upper end portion 26' may be rotated relative to the lower end portion 28', which end portions correspond to the end portions 26 and 28.

The lower end of the end portion 26' includes a rotary coupling or rotary manifold 41 to which the hydraulic lines 29 and 31 are coupled and the lower end portion 28' includes a stationary portion 43 of the rotary coupling 41 to which suitable hydraulic lines may be coupled.

In addition, the lower end of the lower end portion 28' has a hitch frame referred to in general by the reference numeral 45 supported therefrom and the hitch frame 45 includes hydraulically upwardly retractable and downwardly divergent opposite side outrigger assemblies referred to in general by the reference numerals 14' corresponding to the outrigger assemblies 14. The hitch frame 45 includes opposite side low portions 47 to which the lower arms 49 of a three-point hitch assembly referred to in general by the reference numeral 51 carried by a tractor referred to in general by the reference numeral 53 are pivotally connected as at 55 and the hitch frame 45 includes an upper portion 57 to which the upper arm 59 of the three-point hitch 51 is pivotally connected as at 61.

The hitch frame 45 also includes a rearwardly and downwardly inclined support arm 63 pivotally supported from the hitch frame 45 as at 65 and a caster wheel assembly referred to in general by the reference numeral 67 is removably supported from the free end of the arm 63. In addition, connecting structure referred to in general by the reference numeral 69 is operatively connected between the hitch frame 45 and the arm 63 and establishes both upper and lower limits of oscillation of the rear end of the arm 63 and yieldingly biases the latter toward its lower limit position of oscillation.

The rear portion of the hitch frame 45 also includes an operator's platform referred to in general by the reference numeral 69 and the platform 69 may be provided with suitable hydraulic controls for operating the various hydraulic mechanisms of the crane attachment 22'.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A crane including an upright having upper and lower end portions, a boom including base and free end portions, pivot means pivotally supporting said base end portion from the upper end portion of said upright for oscillation relative thereto about a horizontal axis extending transversely of said upright and boom, motor means operably connected between said upright and base end portion for oscillating said boom relative to said upright, said boom base end portion being tubular and said free end portion of said boom including first and second ends, said first end being slidingly received within one end of said base end portion for extension and retraction of the second end of said boom free end portion relative thereto, a hydraulic cylinder operatively connected between said base and free end portions for effecting extension and retraction of the latter, said free end portion of said boom also being tubular, said hydraulic cylinder including a cylinder portion and a piston rod portion projecting outwardly of and extendible and retractable relative to one end of said cylinder portion, the free end of said piston rod portion being anchored relative to the other end of said base end portion of said boom and said one end of said cylinder portion including a mounting plate overlying and removably anchored relative to said first end of said boom free end portion, the second end of said boom free end portion including a horizontal internal cross member therein, the other end of said cylinder portion including an endwise outwardly opening bifurcated end embracingly engaged with said cross member.

2. The combination of claim 1 including support means carried by the lower end portion of said upright for support of the latter from one end of a vehicle.

3. The combination of claim 2 wherein said support means includes a hitch frame mounted on the lower end portion of said upright for support from the three-point hitch of a tractor.

4. The combination of claim 3 wherein said hitch frame includes opposite side upwardly retractable and downwardly divergent outwardly projecting support legs for engagement with the ground upon which said vehicle rests.

5. The combination of claim 4 wherein said upright includes front and rear sides and said hitch frame projects forwardly from said front side for attachment to said three-point hitch, the rear side of said hitch frame including a rear portion thereof spaced to the rear of said upright and from which an elongated support arm is pivotally supported in rearwardly and downwardly inclined positions, the rear lower end of said arm including a caster wheel assembly supported therefrom.

6. The combination of claim 5 wherein the upper end of said arm is pivotally supported from said hitch frame for limited angular displacement relative thereto about a horizontal axis extending transversely of said arm and said upright, and spring means yieldingly biasing said arm toward its limit position with its rear end disposed lowermost.

7. The combination of claim 6 wherein said rear portion of said hitch frame also includes an operator's seat assembly supported therefrom above said support arm.

8. The combination of claim 2 wherein said support means includes a pair of vertically spaced horizontally outwardly projecting mounting flange assemblies projecting horizontally outwardly from the lower end portion of said upright and adapted for interdigitated positioning with and pivotaly support from vertically spaced support flange means carried by the rear end of a backhoe vehicle and from which the backhoe boom thereof is conventionally supported.

9. The combination of claim 1 including a jib extension supported from said free end portion of said boom projecting endwise outwardly therefrom.

10. The combination of claim 1 wherein said upper end portion of said upright is removably supported from the lower end portion thereof.

11. The combination of claim 10 wherein said lower end portion of said upright is tubular and the upper end portion of said upright includes a lower portion downwardly telescoped into the upper end of the lower end portion of said upright.

12. The combination of claim 11 wherein said upper end portion of said upright is supported from the lower end portion thereof for angular displacement relative thereto about an axis paralleling said upright.

13. The combination of claim 12 including motor means operably connected between said upper and lower end portions of said upright for selectively angularly displacing the former relative to the latter.

* * * * *